US009767982B2

(12) United States Patent
Behling et al.

(10) Patent No.: US 9,767,982 B2
(45) Date of Patent: Sep. 19, 2017

(54) MULTIPLE X-RAY BEAM TUBE

(71) Applicant: Koninklijke Philips N.V., Eindhoven (NL)

(72) Inventors: Rolf Karl Otto Behling, Norderstedt (DE); Marcus Walter Foellmer, Hamburg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 91 days.

(21) Appl. No.: 14/765,391

(22) PCT Filed: Jan. 29, 2014

(86) PCT No.: PCT/IB2014/058627

§ 371 (c)(1),
(2) Date: Aug. 3, 2015

(87) PCT Pub. No.: WO2014/125389

PCT Pub. Date: Aug. 21, 2014

(65) Prior Publication Data

US 2015/0380200 A1 Dec. 31, 2015

Related U.S. Application Data

(60) Provisional application No. 61/764,043, filed on Feb. 13, 2013.

(51) Int. Cl.

| | |
|---|---|
| ***H01J 35/08*** | (2006.01) |
| ***H01J 35/12*** | (2006.01) |
| ***H01J 35/24*** | (2006.01) |

(52) U.S. Cl.

CPC ..... *H01J 35/08* (2013.01); *H01J 35/12* (2013.01); *H01J 35/24* (2013.01);
(Continued)

(58) Field of Classification Search

CPC ..... H01J 35/08; H01J 2235/082; H01J 35/06; H01J 35/24; H01J 2235/86; H01J 2235/10; G21K 2207/005
(Continued)

(56) References Cited

U.S. PATENT DOCUMENTS 6,995,382 B2 * 2/2006 Ziener ..... H05G 2/006 250/504 R
7,693,256 B2 4/2010 Brahme et al.
(Continued)

FOREIGN PATENT DOCUMENTS

| | | |
|---|---|---|
| JP | 2003303764 A | 10/2003 |
| WO | 2011070521 A1 | 6/2011 |
| WO | 20120107862 A1 | 8/2012 |

OTHER PUBLICATIONS

Hemberg et al. (2003) Liquid-metal-jet anode electron impact x-ray source, Applied Physics Letters Vo. 83, No. 7, pp. 1483-1485.*
(Continued)

*Primary Examiner* — Courtney Thomas

(57) ABSTRACT

A multiple X-ray beam X-ray source includes an anode structure and a cathode structure. The anode structure includes a plurality of liquid metal jets providing a plurality of focal lines. The cathode structure provides an electron beam structure that provides a sub e-beam to each liquid metal jet. The liquid metal jets are each hit by the sub e-beam along an electron-impinging portion of the jet circumferential surface that is smaller than half of the circumference of a cross-section of the liquid metal jet.

14 Claims, 6 Drawing Sheets

(52) U.S. Cl.
CPC .. *G21K 2207/005* (2013.01); *H01J 2235/082* (2013.01); *H01J 2235/086* (2013.01); *H01J 2235/10* (2013.01)

(58) Field of Classification Search
USPC ..... 378/119–144
See application file for complete search history.

(56) References Cited

U.S. PATENT DOCUMENTS

| | | | | |
|---|---|---|---|---|
| 7,869,567 | B2 | 1/2011 | Olivo et al. | |
| 7,889,838 | B2 | 2/2011 | David et al. | |
| 7,929,667 | B1 * | 4/2011 | Zhuang ..... | H05G 2/003 378/119 |
| 2002/0015473 | A1 | 2/2002 | Hertz et al. | |
| 2002/0141536 | A1 * | 10/2002 | Richardson ..... | H05G 2/003 378/119 |

OTHER PUBLICATIONS

Gasilov et al, "Wide-Field-of-View Phase-Constrast Imaging of Nanostructures With a Comparatively Large Polychromatic Soft X-Ray Plasma Source". Optics Letters, Optical Society of America, vol. 34, No. 21, 2009, XP001549376, pp. 3268-3270.

Tuohimaa, "Liquid-Jet-Target Microfocus X-Ray Sources: Electron Guns, Optics and Phase-Contrast Imaging", Doctoral Thesis, Department of Applied Physics, Royal Institute of Technology, Stockholm, Sweden, 2008, 101 Page Document.

* cited by examiner

MULTIPLE X-RAY BEAM TUBE

CROSS-REFERENCE TO PRIOR APPLICATIONS

This application is the U.S. National Phase application under 35 U.S.C. §371 of International Application No. PCT/IB2014/058627, filed on Jan. 29, 2014, which claims the benefit of U.S. Provisional Patent Application No. 61/764,043, filed on Feb. 13, 2013. These applications are hereby incorporated by reference herein.

FIELD OF THE INVENTION

The present invention relates to the generation of multiple X-ray beams, and relates in particular to a multiple X-ray beam X-ray source, to a system for phase contrast X-ray imaging, and to a method for generating X-ray radiation for phase contrast X-ray imaging, as well as to a computer program element and to a computer readable medium.

BACKGROUND OF THE INVENTION

In phase contrast imaging, an object is radiated with coherent X-ray radiation, for example achieved by placing a grating structure in front of a conventional X-ray tube. For example, WO 2011/070521 A1 relates to differential phase contrast imaging and describes a respective system. A grating in front of the focal spot is provided to enhance the coherence length of the generated X-rays to a useful level. The grating is required to have a transparency that is reduced due to the requirement of having a small slits-to-pitch ratio, for example for the benefit of improved detection of phase shifts. However, it has been shown that for achieving sufficient image data quality, X-ray tubes with increased tube power are needed, which can result in expensive tubes. An example for increasing X-ray tube power is the provision of liquid metal jets acting as the anode for generating the X-ray radiation. For example, U.S. Pat. No. 6,995,382 B2 describes an arrangement for generating intensive radiation based on plasma generation, where the target generator has a multiple channel nozzle with a plurality of target jets for the generation of intensive short wave radiation. The plasma generated from the target jets merge into one extended plasma, leading to a powerful light source. However, the generation of plasma reduces the suitability for phase contrast X-ray imaging. It must be noted further that a source grating would have to be provided, which means additional effort due to the necessary manufacturing steps for the grating. Further, since the X-ray absorbing portions may be provided by gold material which is becoming a more and more expensive material, this also implies negative economic effects.

SUMMARY OF THE INVENTION

There may be a need to provide an X-ray source with the capability of increased tube power for providing coherent radiation that is suitable, for example, in differential phase contrast imaging (DPCI).

The object of the present invention is solved by the subject-matter of the independent claims, wherein further embodiments are incorporated in the dependent claims. It should be noted that the following described aspects of the invention apply also for the multiple X-ray beam X-ray source, the system for phase contrast X-ray imaging, and the method for generating X-ray radiation for phase contrast X-ray imaging, as well as to the computer program element and the computer readable medium.

According to the present invention, a multiple X-ray beam X-ray source is provided with an anode structure and a cathode structure. The anode structure comprises a plurality of liquid metal jets providing a plurality of focal lines. The cathode structure provides an electron beam structure that provides or supplies a sub e-beam to each liquid metal jet. The liquid metal jets are each hit by the sub e-beam along an electron-impinging portion of the circumferential surface that is smaller than half of the circumference.

The liquid metal jets are used as line-like anodes providing multiple X-ray beams. Thus, X-ray radiation in form of several X-ray beams can be provided, acting as coherent radiation, for example for use in phase contrast imaging. The provision of liquid metal jets allows an increased radiation output, due to improved material properties in the sense of temperature transport/cooling function of the liquid metal jets themselves. In other words, liquid metal jets can be subject to increased electron bombardment, i.e. more electrons can impinge on the liquid metal jets, thus generating more powerful X-ray radiation. The multiple line-like anodes also provide the advantage that X-ray radiation is generated in a concentrated way in relation to the actual emission of the needed and used X-ray radiation in coherent way. Thus, already the structure of the focal "spots" takes into account the particular needs with respect to coherent X-ray radiation. The need to absorb or dampen unwanted X-ray radiation is thus reduced and minimized.

According to an example, the focal lines are arranged in at least one plane that is orthogonal to a central beam direction, or that is not orthogonal to the central beam direction.

For example, the focal lines are arranged in at least two planes.

According to an example, the electron beam structure comprises a plurality of individual electron beams supplied as the sub e-beams.

According to another example, the electron beam structure comprises a single electron beam supplied to the liquid metal jets in such a manner that the liquid metal jets provide masking to each other such that only a portion of the circumferential surface that is smaller than half of the circumference is hit by a portion of the single electron beam.

According to an example, each of the liquid metal jets provides masking to the respective proximate metal jet in an electron beam propagation direction.

According to an example, the liquid metal jets are provided with a jet diameter that is approximately twice the size of an electron's penetration depth of the generation of X-rays in phase contrast imaging.

According to a further example, the shape of the liquid metal jets is not circular.

According to a further example, the liquid metal jets are formable dependent on the tube voltage.

According to a further example, the mutual distances of the liquid metal jets are individually adjustable to optimize the fringe pattern.

According to a further example, the mutual distances of the liquid metal jets are adjustable dependent on the tube voltage.

According to a further example, the liquid metal jets are angulated such that parabolic flight paths of the metal are in maximal alignment with a plane that is orthogonal to a central beam.

According to a further example, a stepping arrangement is provided for a common stepping of the liquid metal jets.

According to a further example, an aperture structure is provided with linear openings between diaphragm segments formed by a plurality of liquid jets from X-ray absorbing material.

This allows adjusting of the opening widths, for example.

According to the invention, a system for phase contrast imaging is provided, comprising an X-ray source, a phase grating, an analyzer grating, and an X-ray detector. An object receiving space is provided between the X-ray source and the phase grating. The X-ray source is provided as an X-ray source according to one of the above-mentioned examples.

According to the invention, a method for generating X-ray radiation for phase contrast X-ray imaging is provided, comprising the following steps:

a) generating a plurality of liquid metal jets providing a plurality of focal lines;

b) supplying a sub e-beam to each liquid metal jet; and c) generating X-ray radiation by electrons impinging on the liquid metal jets, wherein the sub e-beams are hitting the liquid metal jets along an electron-impinging portion of the circumferential surface that is smaller than half of the circumference.

According to an aspect of the present invention, an X-ray source is provided that generates a plurality of X-ray radiation sub-beams due to the provision of a plurality of distinct focal lines. These are provided by liquid metal jets that allow an improved power output of the radiation. Electron beams are provided only on a portion of the surface of the jets, i.e. the jets are hit by electrons only on a part of the surface facing the electron beam, and a potion is not hit by electrons. This provides sufficiently small focal lines, i.e. sufficiently thin lines, and it also improves the relation of used X-ray radiation compared to generated X-ray radiation. The need to absorb unwanted X-ray radiation is thus minimized or even reduced completely.

The benefit of using liquid metal jets as anodes in comparison with bulk materials is the ability to restrict the radiation source to a small area in space to achieve the necessary coherence length of the generated wave fronts. As in medical imaging, the X-ray spectrum is adapted to the application to optimize the contrast to noise ratio in varying settings, the optimal wavelength varies as well. It is of benefit, therefore, that the liquid metal jets can be arranged flexibly with respect to their size and distance from each other. Another benefit is their stability in space. When using rotating anodes, the mechanical tolerances infer mechanical distortions of the focal spot position, which have a twofold disadvantage: the position of the focal spot or the focal lines depends on the phase of rotation, which creates undesired synchronization issues with the data readout. Secondly, the focal line size is smeared out when the period of data integration is large with respect to the dwell time of the electron beam on an element of the bulk anode. This smearing-out requires a reduction of size of the electron beam and with it a reduction of the thermal performance of the focal spot. The physical spot needs to be smaller than the X-ray optical focal spot.

Another benefit of liquid metal jets is their confinement to a substantially cylindrical shape, and the large fraction of scattered electrons which emerge during generation of X-rays. These scattered electrons carry a high degree on information of the condition of the interaction zone, i.e. alignment of electron beam and metal jet, which can be evaluated and used for closed loop control to enhance the stability of the source.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1:
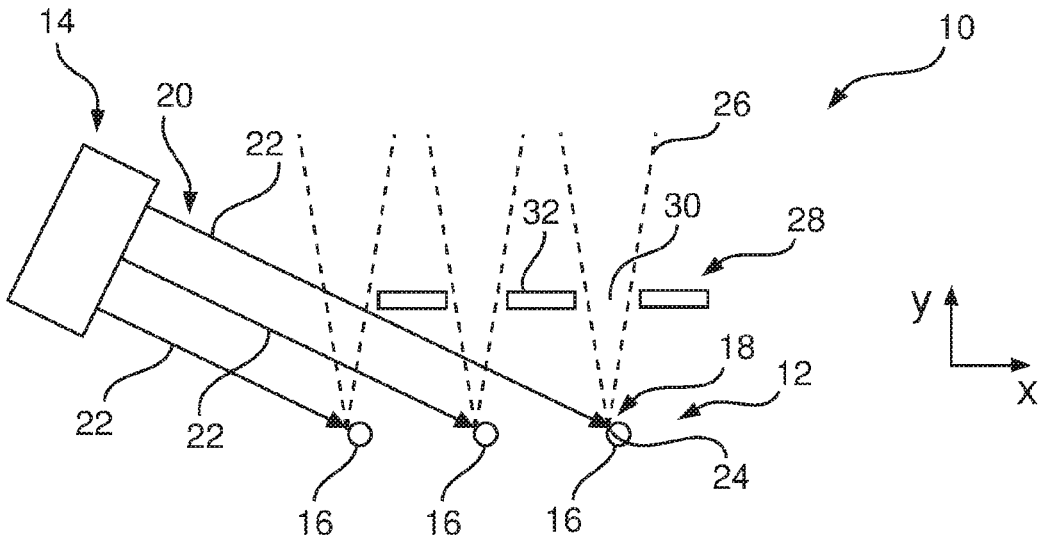
FIG. 1 shows an example of a multiple beam X-ray source in a schematic cross-section.

FIG. 1 shows a multiple X-ray beam X-ray source 10 comprising an anode structure 12 and a cathode structure 14. The anode structure 12 comprises a plurality of liquid metal jets 16 providing a plurality of focal lines 18 (see also FIG. 2). The cathode structure 14 provides an electron beam structure 20 that supplies a sub e-beam 22 to each liquid metal jet 16. The liquid metal jets 16 are each hit by the sub e-beam 22 along an electron-impinging portion 24 of the circumferential surface that is smaller than half of the circumference (see also FIG. 7). Upon the electrons impinging on the electron-impinging portions 24, X-ray radiation 26 is generated, providing multiple X-ray beams, i.e. one beam (or distinct beam portion) for each electron-impinging portion (focal line).

The "multiple X-ray beam X-ray source" is also referred to as multiple X-ray beam source or multi-beam X-ray source.

According to the invention, to create a multitude of fine line X-ray focal spots, a multitude of parallel liquid metal jets is used as anodes. Multiple electron beams, namely the multiple sub e-beams, are directed onto the liquid metal jets, wherein a sub e-beam is directed onto an assigned metal jet each.

The liquid metal jets are provided in a vacuum structure (not further shown).

The multiple X-ray beam X-ray source 10 generates X-ray radiation that is mostly used for imaging purposes. The amount of radiation that is absorbed by aperture structures is reduced to a minimum. The generation of unneeded X-ray radiation is thus minimized or avoided completely.

The term "electron-impinging portion" refers to the portion, which is hit by the electrons, i.e. the portion upon which the electrons impinge. The electron-impinging portion 24 is smaller than approximately two thirds of the half of the circumference, in one example. For example, the electron-impinging portion 24 is smaller than approximately a quarter of the circumference. The term "circumference" relates to the circumferential line and its length of the cross-section of the liquid metal jet 16. With respect to the electron beam impinging from one direction, it is thus ensured that only a portion of the liquid metal jet 16 is hit by electrons and not the complete surface facing towards the electron beam, which would be half of the circumference, in case of electrons impinging from one direction.

As mentioned before, the anode structure 12 provides a plurality of X-ray beams 26. The structure of the X-ray source 10 with its multiple X-ray beams 26 results from the anode structure 12. The focal lines 18 provide the discrete X-ray sources.

For example, an aperture structure 28 may be provided, comprising a plurality of X-ray beam apertures 30, placed in front of a focal line 18 each. To block X-ray radiation in an unwanted direction, X-ray opaque portions 32 are provided separating the X-ray beam apertures 30. However, it must be noted that although the aperture structure 28 is shown in relation with FIG. 1, the aperture structure 28 is not an essential part of the multiple X-ray beam X-ray source and is thus shown as an optional feature.

Figure 2:
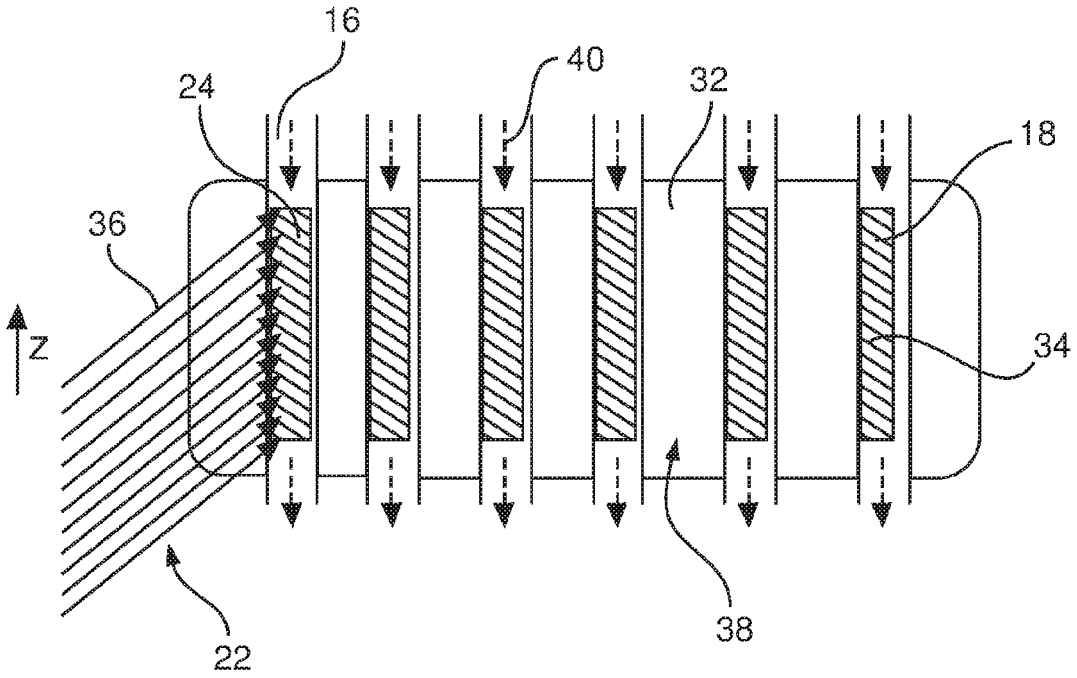
FIG. 2 shows a further example of a multiple X-ray beam X-ray source in a schematic top view.

For example, the liquid metal jets are arranged parallel to each other. As shown in FIG. 2, showing a top view of the arrangement of FIG. 1, the liquid metal jets 16 are shown. A first pattern 34 indicates the provision of the focal lines 18, to which electrons are directed, as indicated with a plurality of arrows 36, forming the sub e-beam 22, hitting the electron-impinging portion 24 of the circumferential surface that is smaller than half of the circumference. A further pattern 38 indicates the X-ray opaque portions 32 of the aperture structure 28, which, as indicated above, is shown as an option. Further, an arrow z indicates a spatial orientation in addition to an x-y-coordinate structure shown in FIG. 1.

Little arrows 40 indicate a flowing direction of the liquid metal jets. The liquid metal jets are shown to be arranged in parallel with the same flowing direction. In a further example (not shown), liquid metal jets may be provided with alternating flowing directions. The focal lines 18 are also referred to as linear shaped focal spots.

As mentioned before, the electron beam structure 20 comprises a plurality of the sub e-beams 22. The sub e-beam 22 is also referred to as electron sub-beam or sub-electron-beam.

Figure 3:
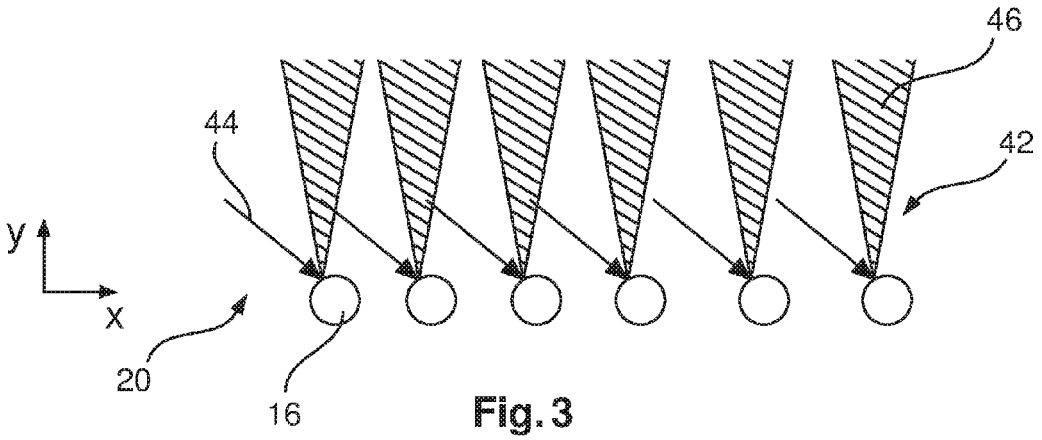
FIGS. 3 and 4 show different examples for an electron beam structure provided to liquid metal jets in schematic cross-sections.

FIG. 3 shows an example of the electron beam structure 20 comprising a plurality 42 of individual electron beams 44, supplied as the sub e-beams 22. A third pattern 46 indicates generated X-ray radiation.

Figure 4:
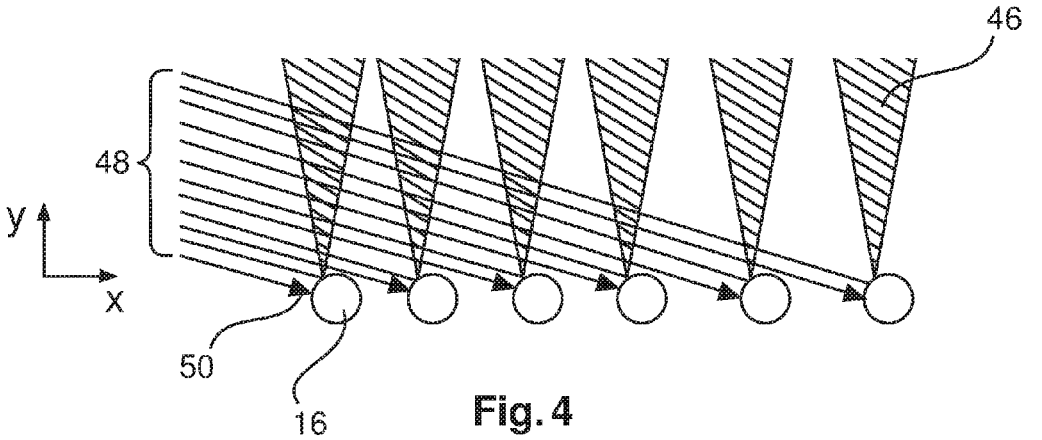

FIG. 4 shows an example where the electron beam structure 20 comprises a single electron beam 48 supplied to the liquid metal jets 16 in such a manner that the liquid metal jets 16 provide masking or shadowing to each other such that only a portion of the circumferential surface that is smaller than half of the circumference is hit by a portion of the single electron beam 48. Each of the liquid metal jets 16 thus provides masking to the respective proximate metal jet 16 in an electron beam propagation direction, indicated with arrow head 50 for the single electron beam 48. For example, the liquid metal jets 16 are placed partly in the electron beam shadow of each other.

Figure 5:
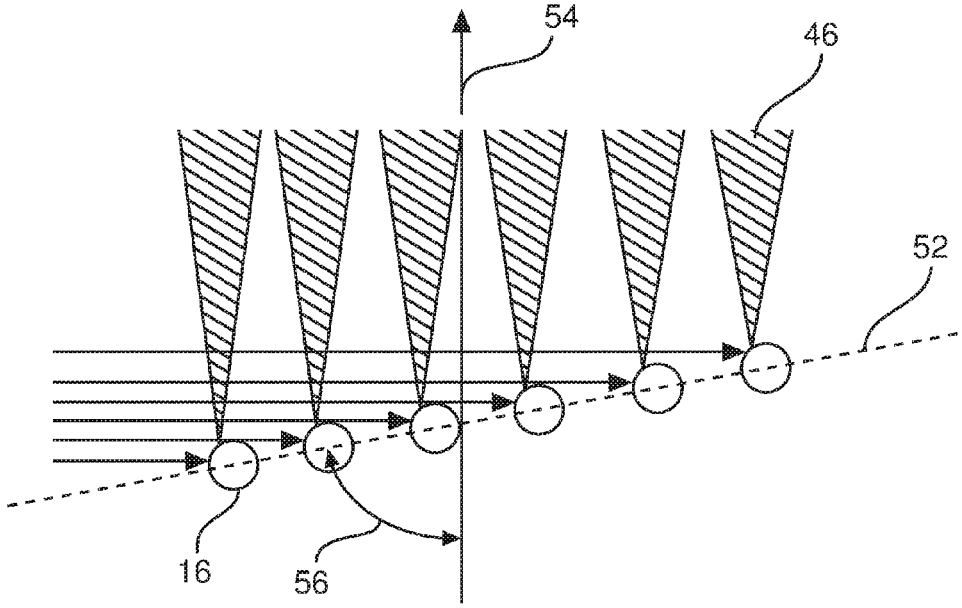
FIG. 5 shows a further example of a multiple X-ray beam X-ray source in a schematic cross-section.

FIG. 5 shows an example where the focal lines 18, and thus the liquid metal jets 16 in case of liquid metal jets 16 of the same structure, are arranged in at least one plane, indicated with dotted line 52 that is not orthogonal to the central beam direction, indicated with arrow 54. An indicated angle 56 is thus smaller than 90 degrees. For example, a facilitated electron optics would be achieved. Further, this also supports the suitability for differential phase contrast imaging. The term "central beam direction" refers to a direction to which the individual X-ray beams of the focal lines are arranged to in a parallel manner.

According to a further example (not shown), the focal lines 18 are arranged in a plane that is orthogonal to the central beam direction 54.

As indicated above, the focal lines 18 are arranged in at least one plane. If the liquid metal jets 16 all have the same cross-section, in particular the same diameter, also the liquid metal jets 16 are arranged in one plane. However, also different jet diameters may be provided, resulting in a different arrangement, with slightly angulated planes, or also a plane for the focal lines and the jets not in a plane.

Figure 6:
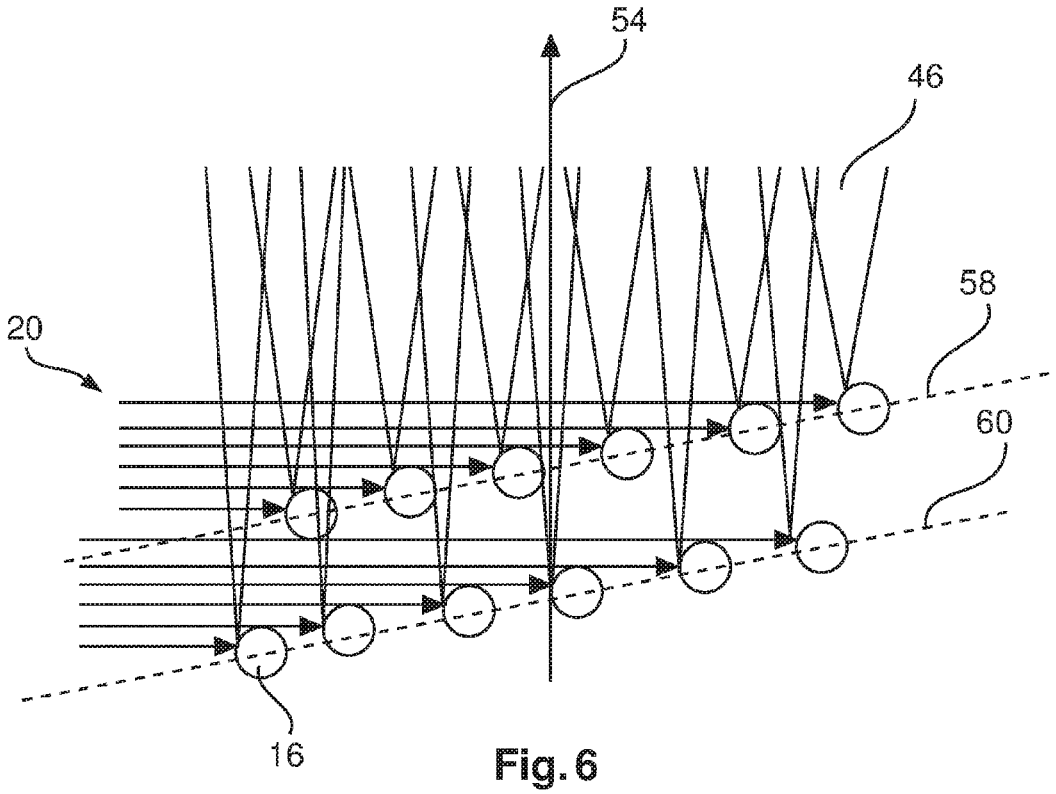
FIG. 6 shows a further example of a multiple X-ray beam X-ray source, also in a schematic cross-section.

According to a further example, shown in FIG. 6, the focal lines are arranged in at least two planes, indicated with two dotted lines 58, 60 in FIG. 6. As shown in one example, the planes are parallel to each other.

In a further example (not further shown), the planes are not parallel to each other but inclined.

According to a further example (also not shown), the planes, for example the planes 58, 60, are orthogonal to the central beam direction 54.

With reference to FIG. 6, the at least two planes, for example two planes, three planes, four planes, five planes, or any higher number, are not orthogonal to the central beam direction 54.

Concerning the arrangement of the liquid metal jets 16 on a multitude of planes, for example two planes, the distance of the metal jets in y-direction, i.e. a direction parallel to the central beam direction 54, may be small compared to the distance from the sources to the object. This provides facilitating the design of the electron optics and also the liquid metal jets, and also improves the suitability for differential phase contrast imaging. The electron beam structure 20 may be provided as a single electron beam for the multitude of planes, or also for an individual single electron beam for the liquid metal jets arranged on each plane.

In a further example, also the individual electron beams 44 as described above may be provided for each liquid metal jet 16.

Figure 7:
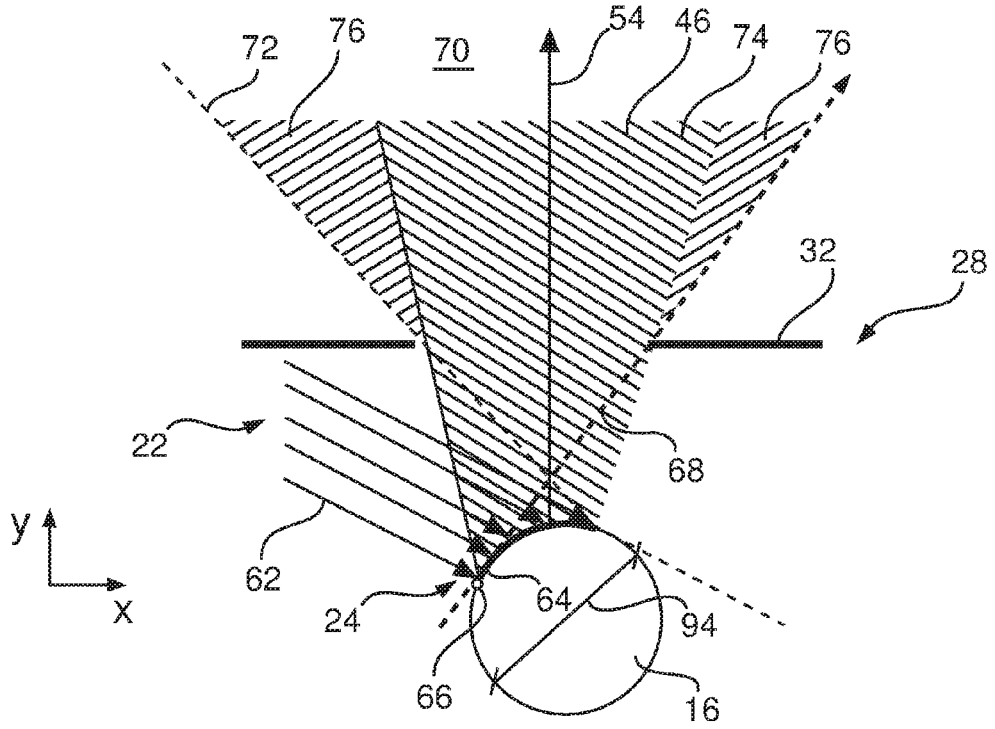
FIG. 7 shows a detailed cross-section of a liquid metal jet according to an example.

FIG. 7 shows a more detailed view of the sub e-beam 22, indicated with a plurality of lines 62, hitting the liquid metal jet 16 for the generation of the X-ray radiation 46. Further, it must be noted that the absorbing portions 32 of the aperture structure 28 are shown as an option.

A first thicker line 64 indicates the electron-impinging portion 24 of the cathode structure of the liquid metal jet, for example arranged with a circular cross-section, wherein the electron-impinging portion is smaller than half of the circumference.

The sub e-beams 22 are placed onto the metal jets 16 such that the full field of view is covered by each X-ray beam. They are further placed such that the X-ray brightness is maximal. Due to the 1/sin(anode angle)-law of the brightness, i.e. the flux of photons into a defined space angle divided by the size of the source, this requires the e-beams to be placed as much sideways from the center as possible. The limit is defined by the heel effect.

The maximal brightness (smallest optical focal area with maximal e-current density) occurs along the tangent plane of the liquid metal beam, which goes through the line of maximal normal e-current density. The line of maximal normal e-current density is running perpendicular to the plane of the figure and is indicated with a small circle 66 in FIG. 7. The line of maximal normal current density, for example, is the case of the transversal current density in the e-beam is constant.

A first dashed line 68 shows a plane of maximal brightness. A field of view 70 is provided between the line 68 and a further dotted line 72. A portion, indicated with a first radiation pattern 74, is arranged around the central beam direction 54, indicating a concentrated X-ray radiation. A second radiation pattern 76 is indicating a portion that is arranged on both sides of the central part, indicating the penumbra of the field of view.

In an example, using a suitable cathode, an in order to maximize the total X-ray flux without thermally overloading the metal jets, the electron beam density may be inhomogeneous, such that the power density on the metal jet is substantially equalized (power density≈1/sin(impact angle)).

Figure 8:
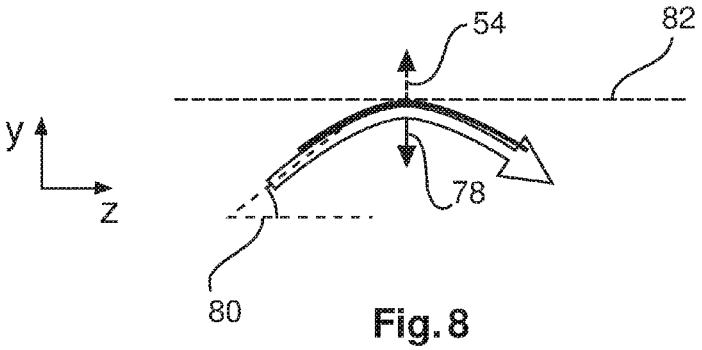
FIG. 8 shows a further example of a liquid metal jet.

In another example, shown in FIG. 8, as the metal jets may be subject to centrifugal forces, indicated with arrow 78, in the X-ray system, the jets may be angulated, indicated with angulation angle 80, such that the parabolic flight paths of the metal are in maximal alignment with a plane 82 which is orthogonal to the central beam direction 54. FIG. 7 is a center-cut through FIG. 8 at the point, where plane 82 touches the metal jet.

Figure 9:
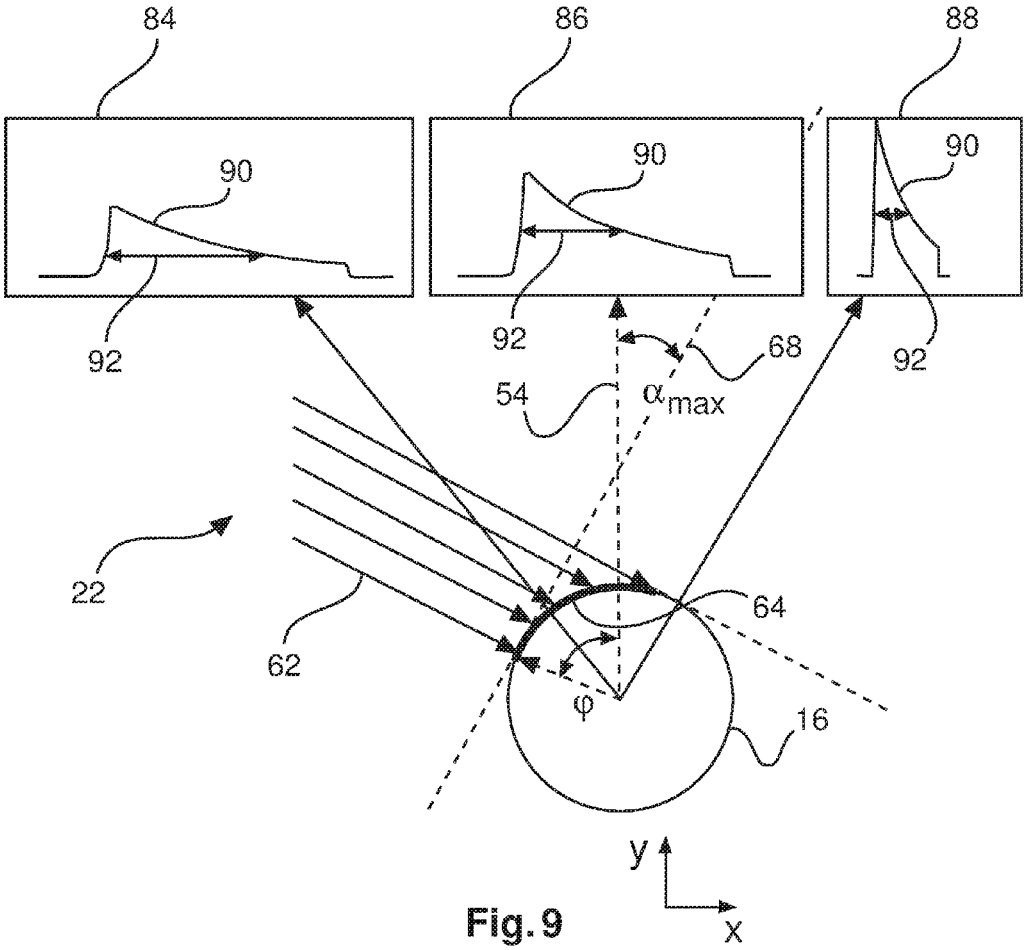
FIG. 9 shows an example of a liquid metal jet and the resulting radiation properties in a schematic cross-section.

FIG. 9 shows the liquid metal jets 16 and the impinging electrons of the sub e-beam 22. A first diagram 84 indicates brightness, effective focal spot width of a left side beam, and a second diagram 86 indicates the same for the central beam, and a third diagram 88 relates to a right side beam. In the diagrams, a graph line 90 indicates the apparent focal spot X-ray intensity profile, as seen with focal spot cameras from different directions, and an arrow 92 indicates the half-width of the full peaks (HWFM). As the X-ray fan covers various directions, the focal spot does not appear of equal size in every direction across the X-ray image.

According to a further example, the liquid metal jets 16 are provided with a jet diameter, indicated with measuring line 94 in FIG. 7 that is, for example, approximately twice the size of an electron's penetration depth of the generation of X-rays in phase contrast imaging.

For example, the liquid metal jets 16 are provided with a jet diameter 94 that is smaller than approximately twice the size of an electron's penetration depth for the generation of X-rays in phase contrast imaging.

The electron's penetration depth may be 5 micrometers.

For example, the liquid metal jets 16 are provided with a jet diameter 94 of 10 micrometers or 5 micrometers.

This provides a limitation of the physical width of the individual focal lines to less than penetration depth of the electrons, which is not achievable with bulk targets. The optical focal width in the light of X-rays is then even smaller.

According to a further example (not further shown), the shape of the liquid metal jets 16 is not circular. For example, the shape is oval or ellipsoid.

According to a further example (not further shown), the liquid metal jets are formable dependent on the tube voltage. For example, the diameter of the liquid metal jets is dependent on the tube voltage. In another example, the shape of the liquid metal jets is dependent on the tube voltage.

Figure 10:
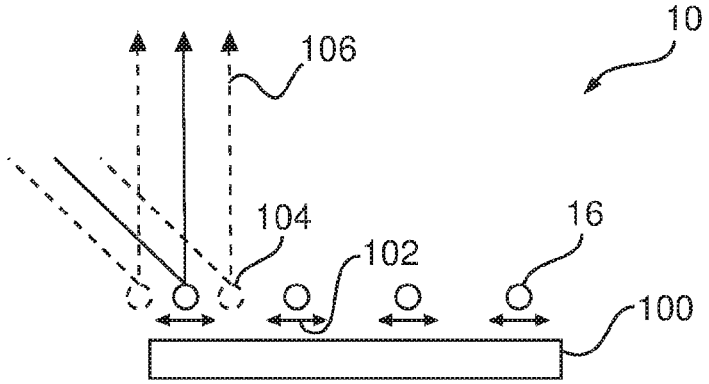
FIG. 10 shows an example of a stepping arrangement for a common stepping of liquid metal jets.

For example, the formability dependent on the tube voltage is provided by mechanical arrangements (not further shown). For example, an adjusting of a pump pressure, adjustable nozzles or the like are provided. FIG. 10 shows a further example of the multiple X-ray beam X-ray source 10, where a stepping arrangement 100 is provided for a common stepping, indicated with double arrows 102, of the liquid metal jets.

For example, the stepping of the jets may be provided as mechanical stepping of a nozzle structure providing the liquid metal jets. In another example (not shown), the stepping of the jets may be provided as an electrostatic or magnetic displacement of the liquid metal jets at least along a length of the jets providing the focal lines. For example, the magnetic displacement is provided by means of current sent through the jets.

In case of an aperture structure, also the aperture structure may be stepped together with the liquid metal jets.

For example, the stepping of the jets results in stepping of the generated X-ray radiation, as indicated in FIG. 10 showing possible positions 104 of the liquid metal jets 16, resulting in different positions 106 of the generated X-ray radiation.

The stepping can be used for the phase contrast imaging and the required stepping in the overall arrangement. Due to larger permitted tolerances, this phase contrast stepping has advantage over stepping of the analyzer grid vs. the phase grid.

Figure 11:
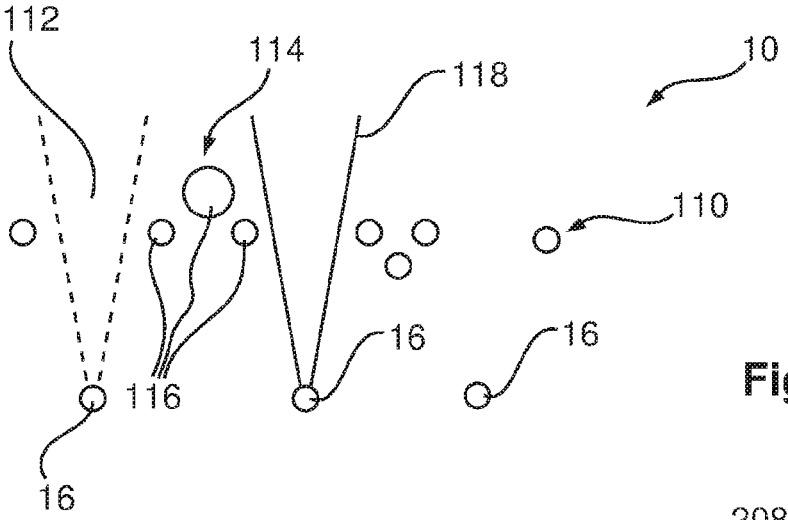
FIG. 11 shows an example of an aperture structure provided by liquid metal jets in a schematic cross-section.

FIG. 11 shows an example of the multiple X-ray beam X-ray source 10 with an aperture structure 110 provided with linear openings 112 between diaphragm segments 114 formed by a plurality of liquid jets 116 from X-ray absorbing material. For example, the plurality of liquid jets is made from an X-ray opaque material.

As indicated in FIG. 11, a single liquid jet may form the diaphragm segment 114, or also a number of same or differently formed liquid jets. Thus, X-ray radiation generated by the liquid metal jets 16 can pass the aperture structure 110, as indicated with lines 118.

Figure 12:
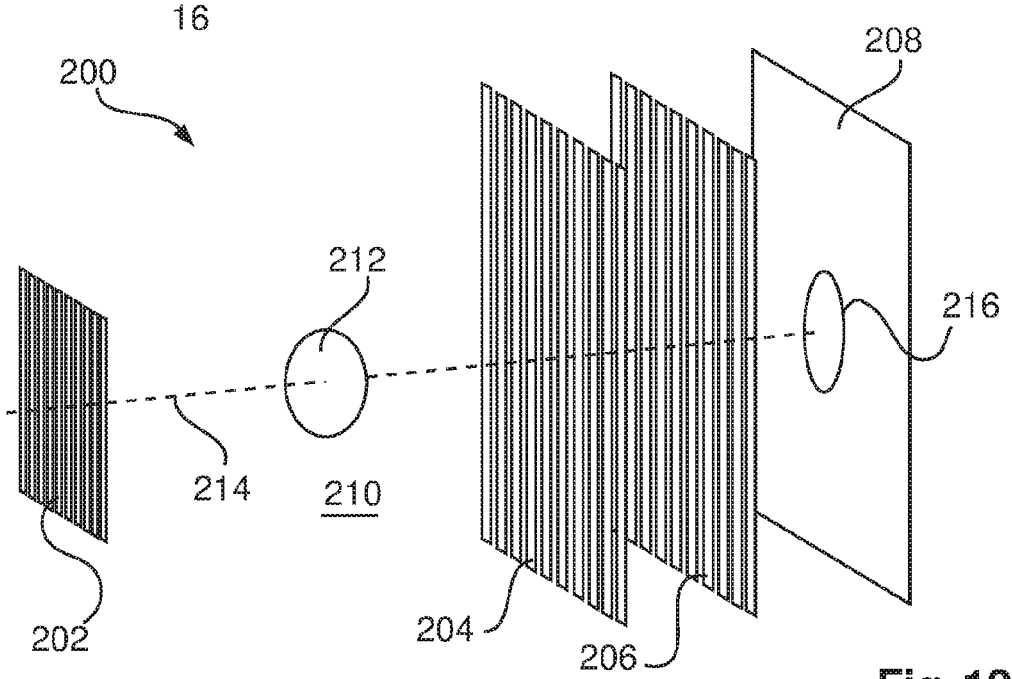
FIG. 12 shows an example for a system for phase contrast X-ray imaging in a schematic setup.

FIG. 12 shows a system 200 for phase contrast X-ray imaging in a schematic setup. The system 200 comprises an X-ray source 202, a phase grating 204, an analyzer grating 206, and an X-ray detector 208. An object receiving space 210 is provided between the X-ray source 202 and the phase grating 204, for example to receive an object 212. Further, a dotted line 214 indicates a central beam axis. A graphic structure 216 indicates the projection of the object 212 on the detector plane 208 in a very schematic way. The X-ray source 202 is provided as an X-ray source 10 according to one of the above-mentioned examples, providing coherent X-ray radiation, which is indicated by the line structure of the X-ray source 202.

Figure 13:
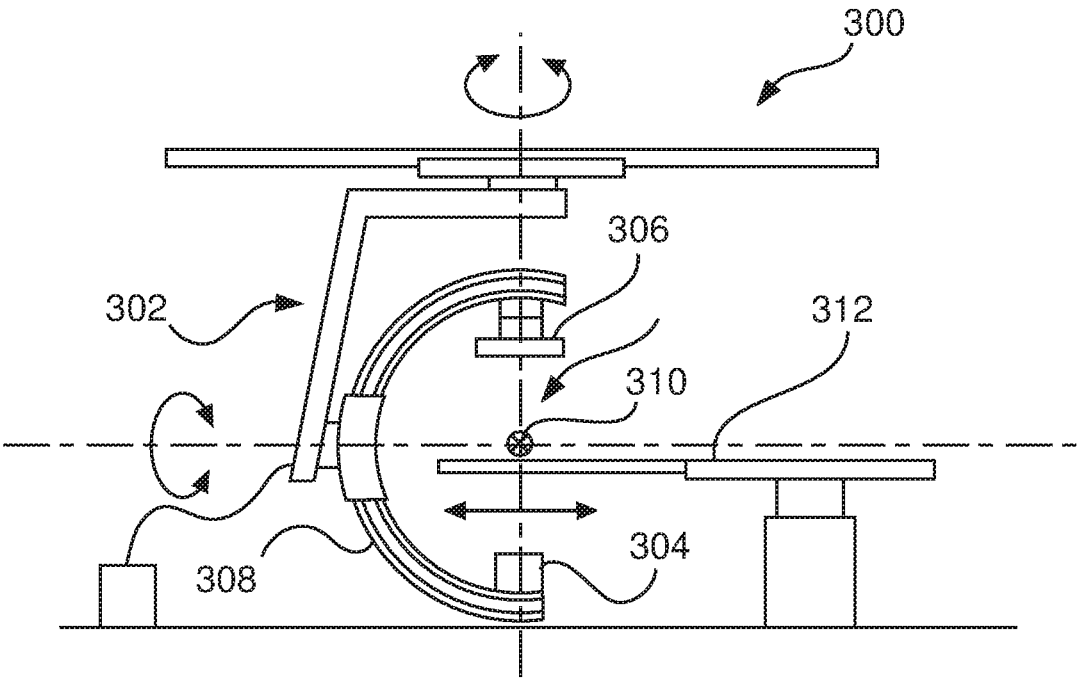
FIG. 13 shows an example for an X-ray imaging system in form of a C-arm structure.

FIG. 13 shows an X-ray imaging system 300 with a C-arm structure 302 having a source 304 and a detector 306 mounted to opposing ends of the C-arm 308. The source 304 and the detector 306 may be provided in accordance with the above-mentioned system 200 for phase contrast X-ray imaging. The C-arm structure 302 allows a movement of the source/detector around an iso-center 310. For example, a patient support 312 is provided to receive a patient.

However, it must be noted that also other X-ray imaging systems may be provided, for example with fixedly mounted X-ray source/X-ray detector arrangements. Further, also other forms of X-ray imaging systems, such as CT structures with a circular gantry may be provided with a system 200 for phase contrast imaging, as described above.

Besides medical imaging, the system 200 for phase contrast X-ray imaging comprising a multiple X-ray beam X-ray source 10 as described above is also suitable for other purposes, such as material control or security inspections.

Figure 14:
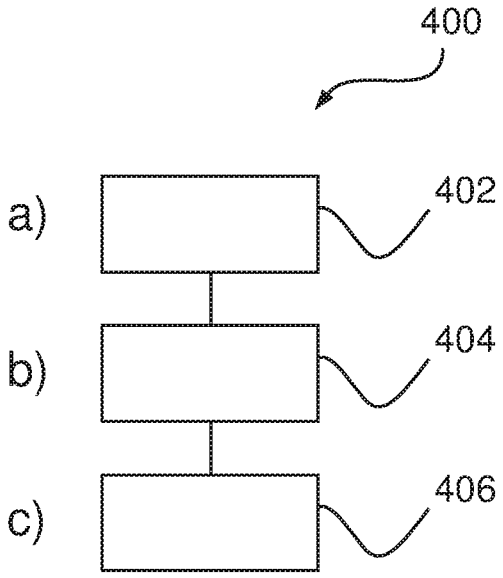
FIG. 14 shows an example of basic steps of a method for generating X-ray radiation.

FIG. 14 shows a method 400 for generating X-ray radiation for phase contrast X-ray imaging. The method 400 comprises a first step 402 of generating a plurality of liquid metal jets providing a plurality of focal lines. In a second step 404, supplying a sub e-beam to each liquid metal jet is provided. In a third step 406, generating X-ray radiation by electrons impinging on the liquid metal jets is provided, wherein the sub e-beams are hitting the liquid metal jets along an electron-impinging portion of the circumferential surface that is smaller than half of the circumference. The first step 402 is also referred to as step a), the second step 404 as step b), and the third step 406 as step c).

In another exemplary embodiment of the present invention, a computer program or a computer program element is provided that is characterized by being adapted to execute the method steps of the method according to one of the preceding embodiments, on an appropriate system. The computer program element might therefore be stored on a computer unit, which might also be part of an embodiment of the present invention. This computing unit may be adapted to perform or induce a performing of the steps of the method described above. Moreover, it may be adapted to operate the components of the above described apparatus. The computing unit can be adapted to operate automatically and/or to execute the orders of a user. A computer program may be loaded into a working memory of a data processor. The data processor may thus be equipped to carry out the method of the invention.

This exemplary embodiment of the invention covers both, a computer program that right from the beginning uses the invention and a computer program that by means of an up-date turns an existing program into a program that uses the invention.

Further on, the computer program element might be able to provide all necessary steps to fulfill the procedure of an exemplary embodiment of the method as described above.

According to a further exemplary embodiment of the present invention, a computer readable medium, such as a CD-ROM, is presented wherein the computer readable medium has a computer program element stored on it which computer program element is described by the preceding section. A computer program may be stored and/or distributed on a suitable medium, such as an optical storage medium or a solid state medium supplied together with or as part of other hardware, but may also be distributed in other forms, such as via the internet or other wired or wireless telecommunication systems. However, the computer program may also be presented over a network like the World Wide Web and can be downloaded into the working memory of a data processor from such a network. According to a further exemplary embodiment of the present invention, a medium for making a computer program element available for downloading is provided, which computer program element is arranged to perform a method according to one of the previously described embodiments of the invention.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfill the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A multiple X-ray beam X-ray source, comprising:

an anode structure; and a cathode structure;

wherein the anode structure comprises a plurality of nozzles configured to provide a plurality of liquid metal jets for providing a plurality of focal lines, wherein the cathode structure provides an electron beam (e-beam) structure that provides a sub e-beam to each liquid metal jet of the plurality of liquid metal jets, wherein the each liquid metal jet is hit by the sub e-beam along an electron-impinging portion of a circumferential surface that is smaller than half of a circumference of the each liquid metal jet.

2. The multiple X-ray beam X-ray source according to claim 1, wherein the focal lines are arranged in at least one plane.

3. The multiple X-ray beam X-ray source according to claim 1, wherein the electron beam structure comprises a plurality of individual electron beams supplied as the sub e-beams.

4. The multiple X-ray beam X-ray source according to claim 1, wherein the electron beam structure comprises a single electron beam supplied to the liquid metal jets in such a manner that the liquid metal jets provide masking to each other such that only the electron-impinging portion of the circumferential surface that is smaller than half of the circumference is hit by a portion of the single electron beam.

5. The multiple X-ray beam X-ray source according to claim 1, wherein each of the liquid metal jets provides masking to the respective proximate metal jet in an electron beam propagation direction.

6. The multiple X-ray beam X-ray source according to claim 1, wherein the liquid metal jets are provided with a jet diameter that is approximately twice the size of an electron's penetration depth of the sub e-beam to each liquid metal jet during the generation of X-rays in phase contrast imaging.

7. The multiple X-ray beam X-ray source according to claim 1, wherein a shape of the liquid metal jets is not circular.

8. The multiple X-ray beam X-ray source according to claim 1, wherein the liquid metal jets are formable dependent on a voltage applied to the multiple X-ray beam X-ray source.

9. The multiple X-ray beam X-ray source according to claim 1, wherein the liquid metal jets are angulated such that parabolic flight paths of liquid metal flowing out of the plurality of nozzles are in maximal alignment with a plane that is orthogonal to a central X-ray beam.

10. The multiple X-ray beam X-ray source according to claim 1, wherein a stepping arrangement is provided for a common stepping of the liquid metal jets.

11. The multiple X-ray beam X-ray source according to claim 1, wherein an aperture structure is provided with linear openings between diaphragm segments formed by a plurality of liquid jets from X-ray absorbing material.

12. A system for phase contrast X-ray imaging, comprising:

an X-ray source;

a phase grating;

an analyzer grating; and an X-ray detector;

wherein an object receiving space is provided between the X-ray source and the phase grating; and wherein the X-ray source comprises:

an anode structure and a cathode structure;

wherein the anode structure comprises a plurality of nozzles configured to provide a plurality of liquid metal jets for providing a plurality of focal lines, wherein the cathode structure provides an electron beam (e-beam) structure that provides a sub e-beam to each liquid metal jet of the plurality of liquid metal jets, wherein the each liquid metal jet is hit by the sub e-beam along an electron-impinging portion of a circumferential surface that is smaller than half of a circumference of the each liquid metal jet.

13. A method for generating X-ray radiation for phase contrast X-ray imaging, comprising acts of:

generating a plurality of liquid metal jets from a plurality of nozzles for providing a plurality of focal lines;

supplying electrons from a sub electron beam (e-beam) to each liquid metal jet of the plurality of liquid metal jets such that each liquid metal jet of the plurality of liquid metal jets is hit by the sub e-beam along an electron-impinging portion of a circumferential surface that is smaller than half of a circumference of the each liquid metal jet; and generating the X-ray radiation by the electrons impinging on the plurality of liquid metal jets.

14. A non-transitory computer readable medium comprising computer instructions for generating X-ray radiation for phase contrast X-ray imaging which, when executed by a processor, configure the processor to perform acts of:

causing generation of a plurality of liquid metal jets from a plurality of nozzles for providing a plurality of focal lines;

causing supply of electrons from a sub electron beam (e-beam) to each liquid metal jet of the plurality of liquid metal jets such that each liquid metal jet of the plurality of liquid metal jets is hit by the sub e-beam along an electron-impinging portion of a circumferential surface that is smaller than half of a circumference of the each liquid metal jet; and causing generation of the X-ray radiation by the electrons impinging on the plurality of liquid metal jets.

* * * * *